US007976320B2

(12) United States Patent
Nishimura

(10) Patent No.: US 7,976,320 B2
(45) Date of Patent: Jul. 12, 2011

(54) POWER PLUG

(75) Inventor: Yoji Nishimura, Tokyo (JP)

(73) Assignee: Furutech Co., Ltd., Tokyo (JP)

( * ) Notice: Subject to any disclaimer, the term of this patent is extended or adjusted under 35 U.S.C. 154(b) by 0 days.

(21) Appl. No.: 12/484,303

(22) Filed: Jun. 15, 2009

(65) Prior Publication Data

US 2010/0035448 A1 Feb. 11, 2010

(30) Foreign Application Priority Data

Jun. 13, 2008 (TW) ..... 97122051 A

(51) Int. Cl.
*H01R 4/66* (2006.01)

(52) U.S. Cl. ..... 439/95; 439/607.34
(58) Field of Classification Search ..... 439/607.34, 439/607.41, 95–97
See application file for complete search history.

(56) References Cited

U.S. PATENT DOCUMENTS 4,405,187 A * 9/1983 Muller et al. ..... 439/607.05
6,716,041 B2 * 4/2004 Ferderer et al. ..... 439/95
7,393,218 B1 * 7/2008 Pavlovic et al. ..... 439/97

* cited by examiner

*Primary Examiner* — Gary F. Paumen
(74) *Attorney, Agent, or Firm* — Peter F. Corless; Steven M. Jensen; Edwards Angell Palmer & Dodge LLP

(57) ABSTRACT

A power plug is proposed, comprising: an electrode terminal base having a pair of electrically conductive terminals and a ground terminal; a power cable having insulated wires respectively connected to the conductive terminals and the ground terminal; a conductive casing comprised of a casing body covering and connecting with the electrode terminal, an isolating portion disposed on the outer layer of the casing body for isolating outside electrical noise or electromagnetic interference, an insulating layer disposed on the inner layer of the casing body, a cable fastener disposed in the casing body for holding the cable in position and a conductive fixture electrically connecting with the electrode terminal base, thereby ensuring the quality of electric power transmission.

20 Claims, 4 Drawing Sheets

POWER PLUG

BACKGROUND OF THE INVENTION

1. Field of the Invention

The present invention relates to a power supply device, and more particularly, to a power plug device capable of enhancing the quality of electrical power transmission.

2. Description of Prior Art

Electromagnetic Interference (EMI) or noise is caused by undesirable radiated electromagnetic fields or applied voltages and conducted currents. Interference is produced by a source emitter and is detected by a susceptible device via a coupling path involving the coupling mechanism of conduction—electric current. Conducted noise is coupled between components through interconnecting wires such as through power supply and ground wires. For example, common impedance coupling is caused when currents from two or more circuits flow through the same impedance such as in power supply and ground wires.

Such generated EMI has been known to interfere and affect the stability of electrical currents flowing through electric apparatus and appliances, and thus compromises device performance and shortens the usage life of the apparatus and appliances, sometimes resulting in such effects as partial overheating, insulation fatigue (break-down) over time, shortened lifespan, poor sound or image quality and so forth.

To assist with the above issues associated with unsteady electrical currents transmitted through electrical apparatus or appliances, Taiwan patent Publication 90127383, which is assigned to the applicant of this invention, has disclosed a power plug as shown in FIG. 1. As shown in the figure, the power plug 200 comprises: a terminal base 110 having a pair of conductive terminals 100 (hot and neutral) and a ground terminal 101, a cable 111 containing insulated wires respectively connected to the conductive terminals 100 and the ground terminal 101, a housing 120 connected with the terminal base 110, and a ground element 130 connecting a third conductor 27 to the ground. In that both the terminal base 110 and the housing 120 are made of insulative plastic material, the ground element 130 is adapted for grounding the third conductor 27 that is isolated from the power plug 200, shielding electromagnetic interference from affecting the power quality.

While the plastic terminal base 110 and the housing 120 are relatively inexpensive, they don't contribute much in terms of shielding against electromagnetic interference. Also, both the plastic terminal base 110 and the housing 120 have low structural rigidity and are prone to transmitting vibrations, thereby affecting electric power transmission and the usage life as a result. Also, it is necessary to employ an additional element for grounding in an attempt to shield against electromagnetic interference. As such, it is desirable and beneficial to provide a novel power plug that can improve on the drawbacks of prior techniques as described above.

SUMMARY OF THE PRESENT INVENTION

In light of the drawbacks associated with the conventional techniques, a primary objective of the present invention is to provide a power plug that can effectively shield electromagnetic interference and noise signals from the outside, thereby ensuring good electrical power transmission.

Another objective of the present invention is to provide a power plug that has a simplified structure with a reduced number of components.

Another objective of the present invention is to provide a power plug device that has a reinforced structure and increased safety.

Another objective of the present invention is to provide a power plug that can reduce and suppress vibration and thus enhance stability.

In accordance with the foregoing and other objectives, the present invention provides a power plug comprising: an electrode terminal base having a pair of electrically conductive terminals and a ground terminal; a power cable having insulated wires respectively connected to the conductive terminals and the ground terminal in the electrode terminal base; a conductive casing comprised of a casing body covering and connecting with the electrode terminal, an isolating portion disposed on the outer layer of the casing body, an insulating layer disposed on the inner layer of the casing body, a cable fastener disposed in the casing body for fastening the cable, and a conductive fixture electrically connecting the electrode terminal base.

In comparison to the conventional techniques, the power plug proposed by the present invention is characterized by employing a conductive casing that reduces the number of conductive components required in conventional power plugs and also effectively shields against outside noise signals and electromagnetic interference via the isolating portion thereof to improve power quality. Accordingly, the present invention yields advantages over prior techniques and has high industrial applicability.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The following illustrative embodiments are provided to illustrate the disclosure of the present invention. The details of the specification may be changed on the basis of different points and applications, and numerous modifications and variations can be devised without departing from the spirit of the present invention.

Figure 2:
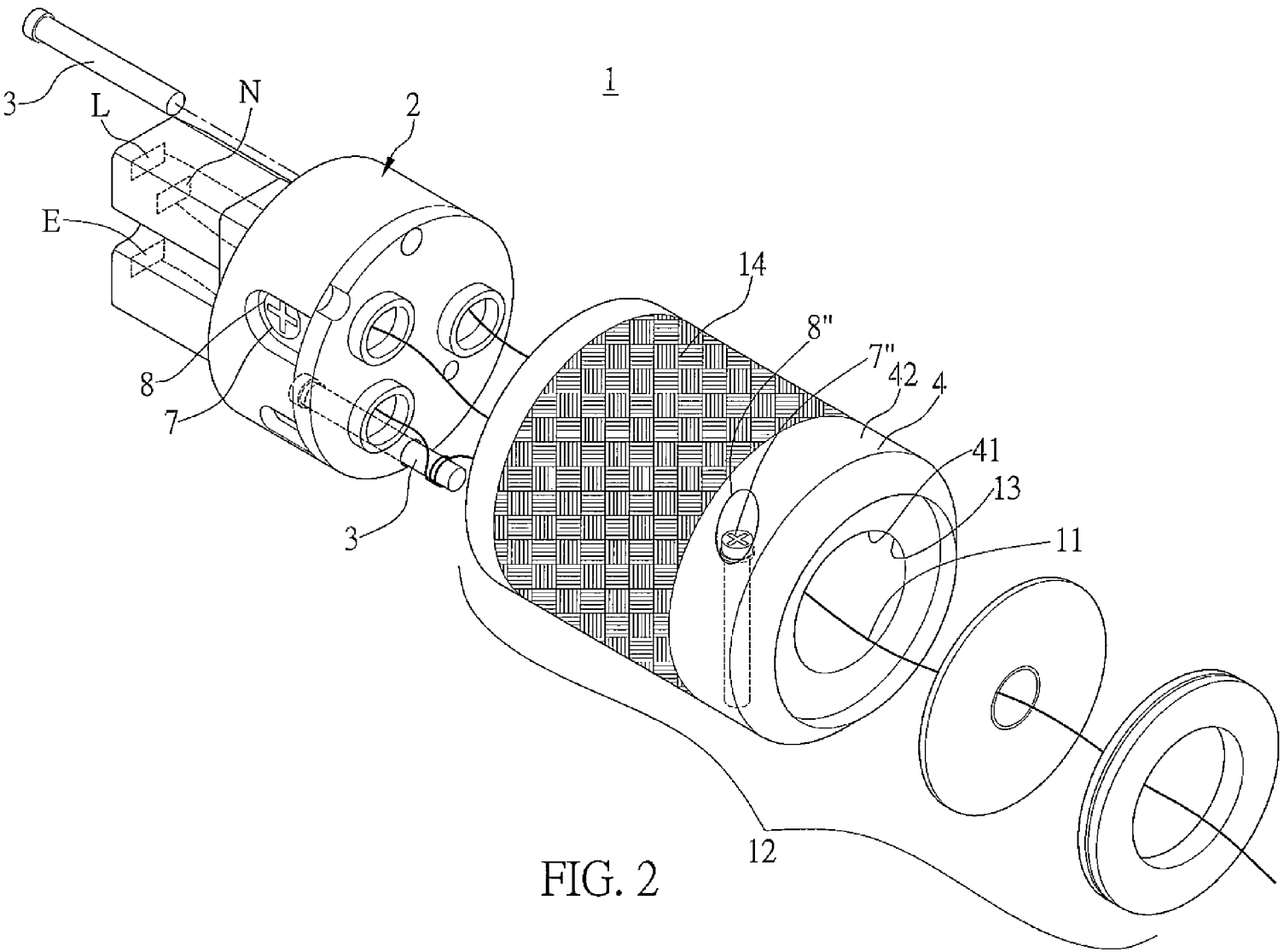
FIG. 2 is an exploded perspective view showing the power plug in accordance with a preferred embodiment of the present invention.

FIG. 2 is an exploded view illustrating a preferred embodiment of the power plug of the present invention. As shown, the power plug 1 is comprised of an electrode terminal base 2, a three-conductor power cable 11, and a conductive casing 12. The electrode terminal base 2 includes a pair of conductive terminals L, N (live and neutral) and a ground terminal E (earth ground), wherein the three insulated wires of the cable 11 are connected to corresponding conductive terminals L, N and the ground terminal E, based on their usage. The conductive casing 12 is electrically connected to the electrode terminal base 2 by a conductive fixture 3, and consists of: a casing body 4 covering and connecting with the electrode terminal base 2, an isolating portion 14 disposed on the outer layer 42 of the casing body 4, an insulating layer 13 disposed on the inner layer 41 of the casing body 4, a cable fastener 5 (shown in FIG. 3) disposed in the casing body 4, the conductive fixture 3 electrically connecting to the electrode terminal base 2, and a first conductive hole (not depicted) disposed in the casing body 4 for receiving the conductive fixture 3 therein. The conductive fixture 3 may be grounded by the conductive property of the conductive casing 12. The isolating portion 14 is disposed over the casing body 4 to shield against electromagnetic waves.

In this preferred embodiment, the conductive casing 12 includes at least a pair of the conductive fixtures 3 passing through the electrode terminal base 2 and inserted into a pair of first conductive holes in the casing body 4. The first conductive holes are adapted for receiving the conductive fixtures 3 therein to conduct with the ground terminal E disposed in the conductive casing 12, wherein the first conductive holes may be screw bores and the conductive fixtures 3 may be corresponding screws.

Figure 3:
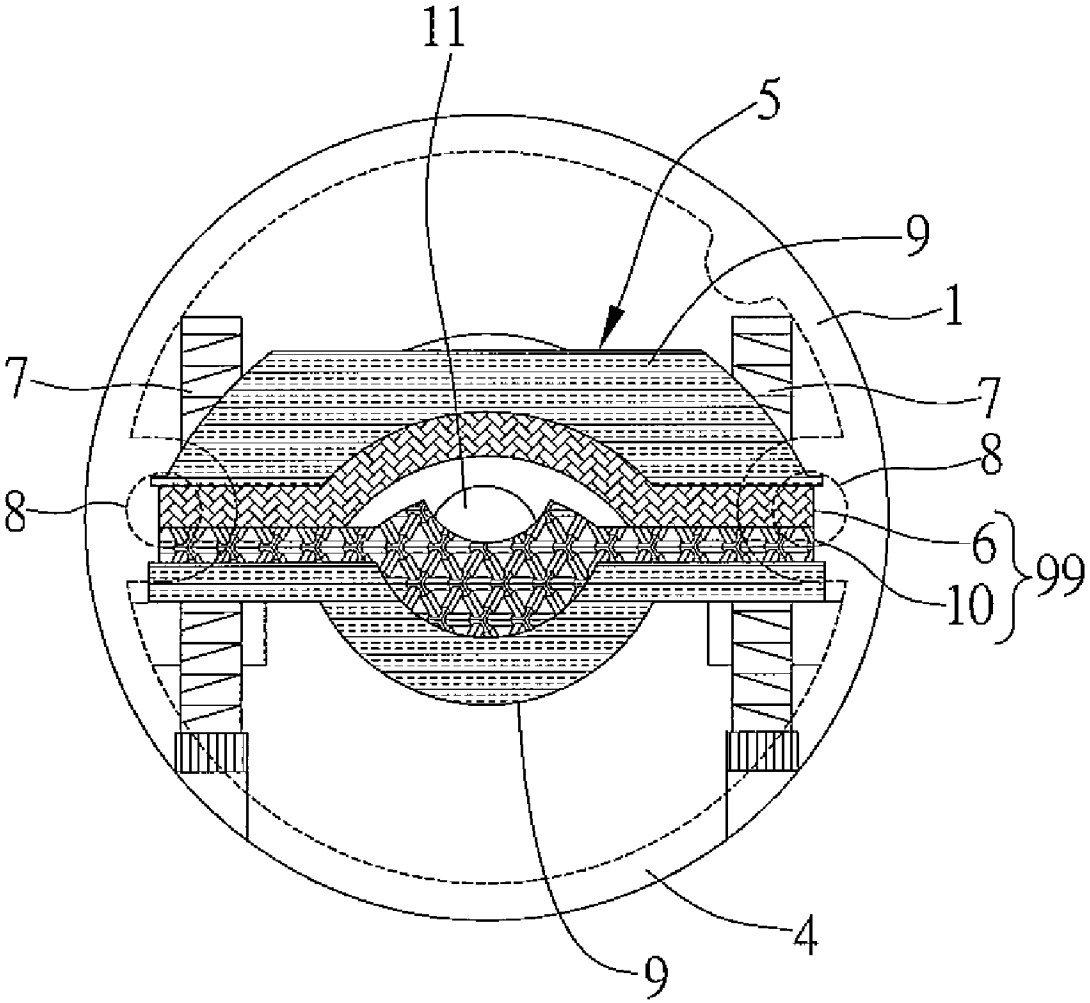
FIG. 3 is a cross-sectional view showing the power plug in accordance with a preferred embodiment of the present invention.

FIG. 3 shows a cross-sectional view of the power plug 1 in accordance with the present invention. The cable fastener 5 consists of a circular-shaped and recessed pressing member 9 disposed at a substantially central position of the casing body 4, and at least a pair of fasteners 7 passing through the conductive casing 12 and screwed to both ends of the pressing member 9. The pressing member 9 is disposed at a short distance from the conductive casing 12 of the casing body 4, an upper washer 6 having a round recess is disposed in the opposite direction of the pressing member 9, and a lower washer 10 having a smaller round recess is disposed between the pressing member 9 and the upper washer 6. Collectively, the upper and lower washers 6, 10 function as a clamping member 99 with a gap formed therebetween for allowing the cable 11 to pass therethrough. Both the left and right ends of the cable fastener 5 are each formed with a second conductive hole through which the conductive casing 12 is engaged with the cable fastener 5 by its fasteners 7. The fasteners may be grounded by the conductive property of the conductive casing 12, and may include screws or other equivalent elements that can be conductively grounded.

In this embodiment, the pressing member 9 may be, but is not limited to, a metallic pressing plate for securely fastening the cable with a strengthened structure to achieve an optimal vibration-suppression effect.

Figure 4:
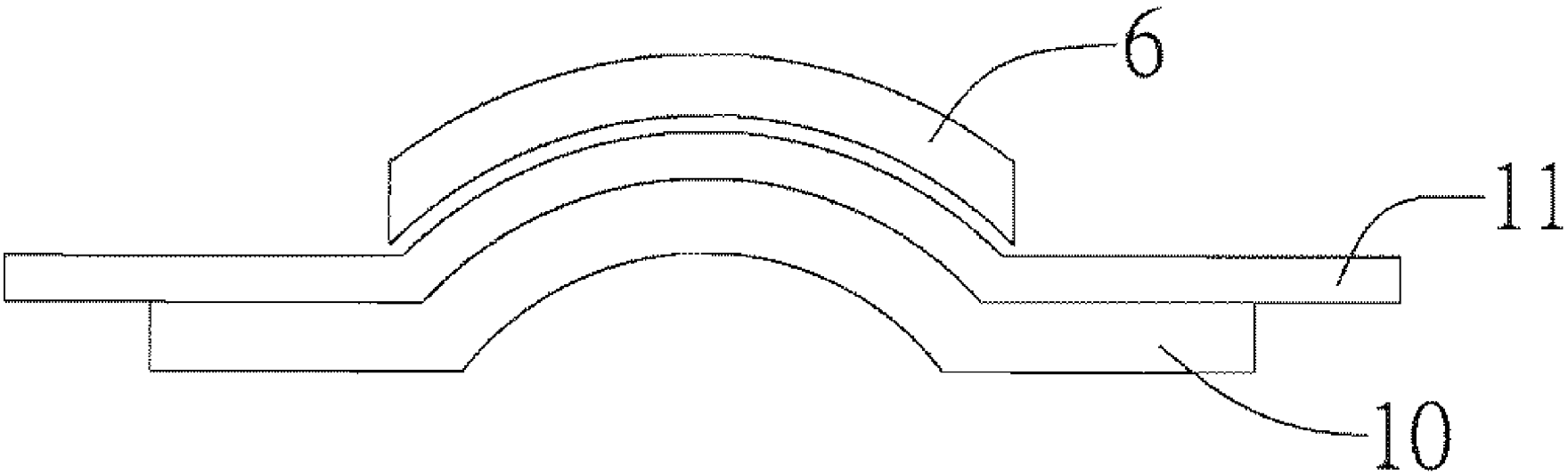
FIG. 4 is a partial cross-sectional view from the right (or left) side of FIG. 3 in the longitudinal direction of the power cable showing the cable fastener applied to and bending the power cable of the power plug in accordance with a preferred embodiment of the present invention.

In addition, the gap formed between the upper and lower washers 6, 10 corresponds to the diameter of the cable 11 for tightly clamping the cable 11 in position. Further, as depicted in FIG. 4, which depicts FIG. 3 from the side, the round recess of the upper and lower washers 6, 10 can be increased to enlarge the contact area with the cable 11 to further secure clamping of the cable 11 to prevent it from loosening or being displaced by transmitted vibration. For example, the washers 6, 10 may be, but are not limited to, plastic washers for protecting the cable 11 clamped theretween. Note that the washers 6, 10 may include insulating washers made of different materials other than that disclosed herein. Further, the pressing member 9 and its fasteners (such as upper and lower washers 6, 10) are not limited to having the circular-shaped recess described above but also can have recesses of different shapes compatible with the cable 11 and expandable to increase the contact area for better clamping stability.

Referring to FIG. 2 and FIG. 3, the cable 11 is fixed at an approximately central position of the power plug 1 after passing through the conductive casing 12, whereupon it is clamped by the pressing member 9 of the cable fastener 5, and the upper and lower washers 6, 10. The washers 6, 10 are made of plastic material corresponding to the insulating layer 13 disposed in the conducting casing 12.

Figure 1:
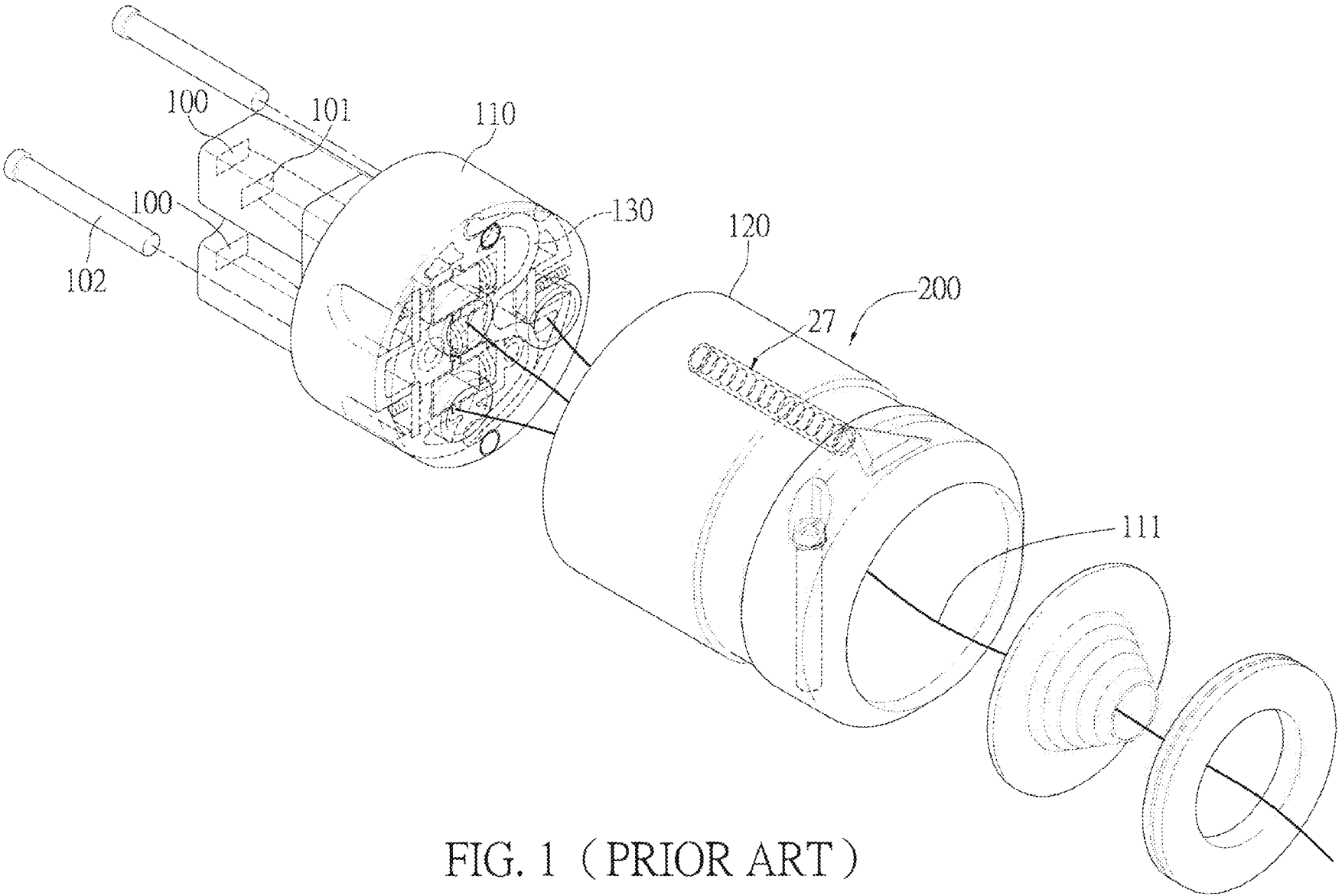
FIG. 1 (PRIOR ART)
FIG. 1 is an exploded perspective view showing a conventional power plug.

Each of the wires in the cable 11 is connected to its corresponding conductive terminals L, N or the ground terminal E in the electrode terminal base 2. Compared to the prior art, there is no need to dispose conductive elements for grounding, as depicted in the third conductor 27 of FIG. 1, since the conductive casing 12 is made of a conductive material inside and out and can be directly ground-conducted. Further, the conductive casing 12 has the isolating portion 14 disposed on the outer layer of the casing body 4 for isolating noise signals and electromagnetic waves to ensure the quality of electrical power transmission.

Further, the casing body 4 of the conductive casing 12 may be made of conductive metals, such as stainless steel, aluminum, iron, copper and the like. The isolating portion 14 may be a carbon fiber compound layer made of carbon fiber compound material, and the insulating layer 13 may be a plastic steel insulating layer made of plastic steel insulating material, but such are not limited to those materials disclosed above. Moreover, the casing body 4 of the conductive casing 12 made of metallic material not only can strengthen the overall structure of the power plug 1, but also the heavy metal weight reduces or suppresses power transmission vibration, thereby improving the power quality as well as the safety in usage.

Naturally, the electrode terminal base 2 may be an insulating body made of compound material such as nylon, glass fiber, pottery ceramic powder and the like. The conductive casing 12 may be made of compound material including metals, carbon fibers and plastic steel insulating layers for strengthening the overall structure with a heavier weight, such that transmission vibrations can be reduced or suppressed to increase the power quality and safety as a result. Moreover, a compound material having pottery ceramic powder can significantly enhance the melting point of the constituent components and is suitable for preventing overheating hazards.

Furthermore, note that the embodiments are provided to illustrate but not limit the disclosure of the present invention. For example, the conductive terminals L, N and the ground terminal E of the electrode terminal base 2 may be a male type power plug (not illustrated) in addition to the conventional female type power plug. Also, elements such as the pressing member, the fixtures and the conductive members may undergo processes of rust-proofing and the like to prolong the usage life.

While illustrative embodiments are provided in the above description, such embodiments are for illustration of the principles and functions of the present invention only and they are not to be construed restrictively. Various modifications and variations of the present invention will be obvious to those skilled in the art and yet still fall within the spirit and scope of the invention as set forth in the following claims.

What is claimed is:

1. A power plug, comprising:

an electrode terminal base having a pair of electrically conductive terminals and a ground terminal;

a power cable having insulated wires corresponding connected to the conductive terminals and the ground terminal; and a conductive casing comprised of a casing body covering and connecting with the electrode terminal, an isolating portion disposed on the outer layer of the casing body, an insulating layer disposed on the inner layer of the casing body, a cable fastener disposed in the casing body for fastening the power cable, and a conductive fixture electrically connecting with the electrode terminal base, wherein the casing body comprises at least a pair of conductive fixtures each inserted into a conductive hole formed therein and electrically connected to the ground terminal.

2. The power plug according to claim 1, wherein the conductive hole is a screw bore and the conductive fixture is a corresponding screw.

3. The power plug according to claim 1, wherein the cable fastener consists of two pressing members disposed in the casing body, a clamping member disposed between the pressing members for clamping the power cable in place, and at least a pair of fasteners passing through the casing body and disposed at both ends of the pressing member.

4. The power plug according to claim 3, wherein the pressing members and the clamping member are each formed with a recess having a shape corresponding to that of the power cable.

5. The power plug according to claim 4, wherein the recess is semicircular shaped.

6. The power plug according to claim 3, wherein at least one of the pressing members is a pressing plate, the clamping member is an insulating washer and the fastener is a screw.

7. The power plug according to claim 6, wherein the pressing member is a metal pressing plate and the clamping member is a plastic washer.

8. The power plug according to claim 1, wherein the electrode terminal base is an insulating body constituted by compound material selected from and including nylon, glass fiber, and pottery ceramic powder.

9. The power plug according to claim 1, wherein the conductive casing is made of compound material consisting of metals, carbon fibers and fiber reinforced polymer (FRP) composite insulating layers.

10. The power plug according to claim 1, wherein the isolating portion is a carbon fiber compound layer made of carbon fiber compound material.

11. A power plug, comprising:

an electrode terminal base having a pair of electrically conductive terminals and a ground terminal;

a power cable having insulated wires corresponding connected to the conductive terminals and the ground terminal; and a conductive casing comprised of a casing body covering and connecting with the electrode terminal, an isolating portion disposed on the outer layer of the casing body, an insulating layer disposed on the inner layer of the casing body, a cable fastener disposed in the casing body for fastening the power cable, and a conductive fixture electrically connecting with the electrode terminal base, wherein the cable fastener consists of two pressing members disposed in the casing body, a clamping member disposed between the pressing members for clamping the power cable in place, and at least a pair of fasteners passing through the casing body and disposed at both ends of the pressing member.

12. The power plug according to claim 11, wherein the casing body comprises at least a pair of conductive fixtures each inserted into a conductive hole formed therein and electrically connected to the ground terminal.

13. The power plug according to claim 12, wherein the conductive hole is a screw bore and the conductive fixture is a corresponding screw.

14. The power plug according to claim 11, wherein the electrode terminal base is an insulating body constituted by compound material selected from and including nylon, glass fiber, and pottery ceramic powder.

15. The power plug according to claim 11, wherein the conductive casing is made of compound material consisting of metals, carbon fibers and fiber reinforced polymer (FRP) composite insulating layers.

16. The power plug according to claim 11, wherein the isolating portion is a carbon fiber compound layer made of carbon fiber compound material.

17. A power plug, comprising:

an electrode terminal base having a pair of electrically conductive terminals and a ground terminal;

a power cable having insulated wires corresponding connected to the conductive terminals and the ground terminal; and a conductive casing comprised of a casing body covering and connecting with the electrode terminal, an isolating portion disposed on the outer layer of the casing body, an insulating layer disposed on the inner layer of the casing body, a cable fastener disposed in the casing body for fastening the power cable, and a conductive fixture electrically connecting with the electrode terminal base, wherein the conductive casing is made of compound material consisting of metals, carbon fibers and fiber reinforced polymer (FRP) composite insulating layers.

18. The power plug according to claim 17, wherein the isolating portion is a carbon fiber compound layer made of carbon fiber compound material.

19. The power plug according to claim 17, wherein the casing body comprises at least a pair of conductive fixtures each inserted into a conductive hole formed therein.

20. The power plug according to claim 17, wherein the cable fastener consists of two pressing members disposed in the casing body, a clamping member disposed between the pressing members for clamping the power cable in place, and at least a pair of fasteners passing through the casing body and disposed at both ends of the pressing member.

* * * * *